US007632084B2

(12) United States Patent
Sawai et al.

(10) Patent No.: US 7,632,084 B2
(45) Date of Patent: Dec. 15, 2009

(54) OILLESS ROTARY VANE PUMP HAVING OPEN ENDS OF VANE GROOVES BEING INCLINED REARWARD IN THE ROTATION DIRECTION

(75) Inventors: Kiyoshi Sawai, Shiga (JP); Atsushi Sakuda, Shiga (JP); Tatsuya Nakamoto, Shiga (JP); Noboru Iida, Shiga (JP); Ryuichi Ohno, Shiga (JP)

(73) Assignee: Panasonic Corporation, Kadoma-Shi (JP)

( * ) Notice: Subject to any disclaimer, the term of this patent is extended or adjusted under 35 U.S.C. 154(b) by 166 days.

(21) Appl. No.: 11/578,053

(22) PCT Filed: Jul. 27, 2005

(86) PCT No.: PCT/JP2005/013736

§ 371 (c)(1),
(2), (4) Date: Oct. 12, 2006

(87) PCT Pub. No.: WO2006/013761

PCT Pub. Date: Feb. 9, 2006

(65) Prior Publication Data

US 2007/0217937 A1 Sep. 20, 2007

(30) Foreign Application Priority Data

Aug. 2, 2004 (JP) ..... 2004-225360

(51) Int. Cl.
*F01C 1/00* (2006.01)
*F03C 2/00* (2006.01)

(52) U.S. Cl. ..... 418/236; 418/152; 418/178

(58) Field of Classification Search ..... 418/236–238, 418/259, 265, 152, 178, 179, 131–133
See application file for complete search history.

(56) References Cited

U.S. PATENT DOCUMENTS 19,004 A * 12/1857 Young ..... 418/236

(Continued)

FOREIGN PATENT DOCUMENTS

DE 2600972 A * 3/1977

(Continued)

OTHER PUBLICATIONS

Chinese Office Action dated Oct. 19, 2007 w/translation.

(Continued)

*Primary Examiner*—Theresa Trieu
(74) *Attorney, Agent, or Firm*—Kratz, Quintos & Hanson, LLP

(57) ABSTRACT

It is an object of the present invention to provide a vane rotary type air pump in which a pump mechanism and a drive motor are directly connected to each other and low noise is realized. In the vane rotary type air pump in which a cylinder (103), a rotor (110 ) and a vane (112) are sandwiched between a front plate (not shown) and a rear plate (not shown), an opened end (111*b*) of the vane groove (111) is provided in a reversed rotation direction region of the rotor (110) with respect to straight line connecting a center O of the rotor (110) and the closed end (111*a*) of the vane groove (111). That is, a "stroke" type vane disposition is employed. With this noise of the air pump is reduced.

5 Claims, 5 Drawing Sheets

U.S. PATENT DOCUMENTS

| | | | | | |
|---|---|---|---|---|---|
| 3,187,993 | A | * | 6/1965 | Rhodes | 418/131 |
| 4,051,893 | A | * | 10/1977 | Guibert | 418/236 |
| 4,276,007 | A | * | 6/1981 | Sakamaki et al. | 418/178 |
| 4,616,985 | A | * | 10/1986 | Hattori et al. | 418/178 |
| 5,573,390 | A | * | 11/1996 | Takeuchi et al. | 418/178 |
| 6,474,751 | B1 | | 11/2002 | Yamaguchi et al. | |

FOREIGN PATENT DOCUMENTS

| | | | |
|---|---|---|---|
| EP | 1550810 | A1 * | 7/2005 |
| JP | 51-69205 | | 6/1976 |
| JP | 52-170708 | | 12/1977 |
| JP | 2-125991 | | 5/1990 |
| JP | 8-93658 | | 4/1996 |
| JP | 2001214875 | A * | 8/2001 |
| JP | 2004-225615 | | 8/2004 |
| WO | 2004/029462 | | 4/2004 |

OTHER PUBLICATIONS

Chinese Office Action mailed Jul. 17, 2009, including an English-language translation.

* cited by examiner

OILLESS ROTARY VANE PUMP HAVING OPEN ENDS OF VANE GROOVES BEING INCLINED REARWARD IN THE ROTATION DIRECTION

TECHNICAL FIELD

The present invention relates to an oilless vane rotary type air pump used for a fuel cell for a mobile device.

BACKGROUND TECHNIQUE

At present, a fuel cell for mobile use is under development, and an appropriate air pump for supplying air to a cell of the fuel cell does not exist. It is required that the air pump of this kind has the following characteristics: supplied air does not include impurities such as oil, i.e., the air pump is of an oilless mechanism, an amount of supplied air may be relatively small flow rate of about 5 L/min to 10 L/min, but in order to overcome a pressure loss generated in an air passage of the cell of the fuel cell and to send air, it is necessary that the pressure $\Delta P$ is equal to 5 kPa, a diameter of the air pump is about $\phi$30 mm or less because the air pump must be incorporated in a mobile device, and noise level is low.

As an air pump which satisfies these characteristics, a vane rotary type air pump seems to be admissible. A conventional vane rotary type pump will be explained with reference to FIGS. 8 and 9.

In a conventional vane rotary type vacuum pump of this kind, a cylindrical rotor 2 is disposed in a cylinder 1 having a cylindrical inner surface, a center axis of the rotor 2 is separated from a center axis of the cylinder 1 by a predetermined amount, a plurality of vane grooves 3 are provided in the rotor 2 in a direction of the center axis thereof, plate-like vanes 4 are slidably fitted in the vane grooves 3, and tip ends of the vanes 4 contact with and slide on the inner surface of the cylinder 1. An open end of each of the vane grooves 3 is located in a region in a rotation direction of the rotor 2 with respect to a straight line connecting a center of the rotor 2 and a closed end of that vane groove 3. That is, the vane grooves 3 are inclined in the rotation direction, and when the rotor 2 rotates, tip ends of the vanes 4 contact with and slides on the inner surface of the cylinder in a "scooping" positional relation (see patent document 1 for example).

Alternately, the vane grooves 3 are disposed radially from the center axis of the rotor 2 (see patent document 2 for example).

[Patent Document 1] Japanese Patent Application Laid-open No. S62-276291

[Patent Document 2] Japanese Utility model Application Laid-open No. S56-83688

DISCLOSURE OF THE INVENTION

Problem to be Solved by the Invention

However, in the conventional vacuum pump of scooping type vane structure, if oilless operation is carried out for a long time, the inner surface of the cylinder roughens, surface roughness is prone to increase, and a friction force acting on the tip ends of the vanes is gradually increased. As a result, the tip ends of the vanes are separated (jumping) from the inner surface of the cylinder when the rotor rotates. If the tip ends of the vanes are intermittently separate when the rotor rotates, and there is a problem that the vanes collide against the inner surface of the cylinder to generate sound, air leaks from a gap of the tip end of the vane, and expansion sound is generated.

The present invention has been accomplished to solve the conventional problem, and it is an object of the invention to provide a vane rotary type air pump realizing low noise even if oilless operation is carried out for a long term.

MEANS FOR SOLVING THE PROBLEM

A first aspect of the present invention provides a vane rotary type air pump in which a pump mechanism and a drive motor are provided side-by-side, the pump mechanism comprises a cylinder having a cylindrical inner surface, a cylindrical rotor which eccentrically rotates in the cylinder, a vane groove having an opened end in an outer peripheral surface of the rotor and a closed end on the side of a center of the rotor, a vane which slides in the vane groove, a rotation shaft which rotates in unison with the rotor, and front and rear plates which are mounted on both end surfaces of the cylinder such as to sandwich the rotor and the vane, the pump mechanism is formed with a plurality of pump spaces, and the rotation shaft is driven by the drive motor to vary volumes of the pump spaces, wherein the opened end of the vane groove is provided in a reversed rotation direction region of the rotor with respect to straight line connecting a center of the rotor and the closed end of the vane groove.

According to a second aspect of the invention, in the first aspect, a base material of the vane is carbon material in which graphite is mixed or a carbon fiber reinforced plastics, and a surface of the cylinder is made of material having higher hardness than that of the vane and having corrosion resistance.

According to a third aspect of the invention, in the first aspect, the cylinder is made of aluminum alloy, the cylinder is subjected to surface processing using Ni—P-based material or Ni—P-B-based material, and Vickers hardness (Hv) of the surface of the cylinder is set to 500 or higher.

According to a fourth aspect of the invention, in the first aspect, the vane is made of carbon material having Shore hardness (Hs) of 80 to 120.

According to a fifth aspect of the invention, in the first aspect, the front plate is formed with an intake opening and a discharge port, the rear plate is formed with an intake port and a pseudo-discharge port, the intake port of the rear plate is disposed at a position opposed to the intake opening of the front plate, and the pseudo-discharge port of the rear plate is disposed at a position opposed to the discharge port of the front plate.

According to a sixth aspect of the invention, in the fifth aspect, the pseudo-discharge port has the same shape as that of the discharge port.

A seventh aspect of the invention provides a vane rotary type air pump which comprises a cylinder having a cylindrical inner surface, a cylindrical rotor which eccentrically rotates in the cylinder, a vane groove having an opened end in an outer peripheral surface of the rotor and a closed end on the side of a center of the rotor, and a vane which slides in the vane groove, wherein the opened end of the vane groove is provided in a reversed rotation direction region of the rotor with respect to straight line connecting a center of the rotor and the closed end of the vane groove.

EFFECT OF THE INVENTION

According to the vane rotary type air pump of the present invention, since the vane jumping phenomenon is suppressed even if the air pump is operated in the oilless manner for a long term, it is possible to suppress a case in which collision sound of vane is generated and expansion sound is generated due to leakage of air, and low noise can be realized for a long term.

EXPLANATION OF SYMBOLS

Figure 1:
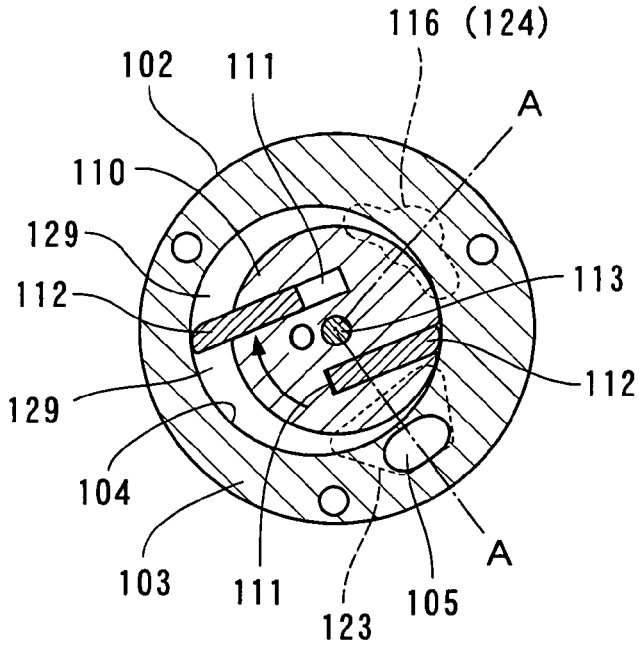
FIG. 1 is a sectional view of a vane rotary type air pump of an embodiment of the present invention.

101 air pump main body
102 pump mechanism
103 cylinder
104 cylinder inner surface
105 intake passage
110 rotor
111 vane groove
111*a* closed end
111*b* opened end
112 vane
113 rotation shaft
114 front plate
115 intake opening
116 discharge port
117 discharge pipe
122 rear plate
123 intake port
129 pump space
130 drive motor

BEST MODE FOR CARRYING OUT THE INVENTION

In the vane rotary type air pump according to the first aspect of the invention, the opened end of the vane groove is provided in a reversed rotation direction region of the rotor with respect to straight line connecting a center of the rotor and the closed end of the vane groove. According to this aspect, the vane groove is provided on the rear side in the rotation direction. With this, when the rotor rotates, the tip end of the vane contacts and slides in a "stroke" positional relation with respect to the inner surface of the cylinder. If a friction force is generated on the tip end of the vane, this friction force acts such as to bring the tip end of the vane into contact with the inner surface of the cylinder, and a jumping phenomenon is prone to be generated when the vane contacts with and slides on the inner surface of the cylinder. According to this aspect, this jumping phenomenon can be suppressed, and low noise can be realized for a long term.

According to the second aspect of the invention, in the vane rotary type air pump of the first aspect, a base material of the vane is carbon material in which graphite is mixed or a carbon fiber reinforced plastics, and a surface of the cylinder is made of material having higher hardness than that of the vane and having corrosion resistance. According to this aspect, if the tip end of the vane contacts with and slides on the cylinder inner surface, the vane having relatively low hardness is worn little by little, the wearing powder functions as lubricant agent of the sliding surface, and this prevents the cylinder inner surface from roughening. As a result, increase in wear between the tip end of the vane and the cylinder inner surface is suppressed, the lifetime of the pump can be increased and the increase in noise can be suppressed.

According to the third aspect of the invention, in the vane rotary type air pump of the first aspect, the cylinder is made of aluminum alloy, the cylinder is subjected to surface processing using Ni—P-based material or Ni—P-B-based material, and Vickers hardness (Hv) of the surface of the cylinder is set to 500 or higher. According to this aspect, when the surface processed layer of the cylinder and the vane made of carbon-based material contacts with and slides on each other, substantially only the vane is worn, and surface roughness of the surface processed layer of the cylinder is maintained small. As a result, the friction force at the sliding portion is not increased, the lifetime of the pump can be increased and the increase in noise can be suppressed.

According to the fourth aspect of the invention, in the vane rotary type air pump of the first aspect, the vane is made of carbon material having Shore hardness (Hs) of 80 to 120. According to this aspect, the vane is made of carbon material having Shore hardness (Hs) of 115 or lower. With this, when the tip end of the vane slides on the cylinder inner surface, wearing powder of the vane is generated, but since the vane is made of material of Hs115 or lower, a great amount of graphite is included in the wearing powder, and the sliding portion is lubricated by the graphite powder. Therefore, even if the pump is operated for a long term, the roughness of the cylinder inner surface is suppressed, the lifetime of the pump can further be increased and the increase in noise can be suppressed.

According to the fifth aspect of the invention, in the vane rotary type air pump of the first aspect, the front plate is formed with an intake opening and a discharge port, the rear plate is formed with an intake port and a pseudo-discharge port, the intake port of the rear plate is disposed at a position opposed to the intake opening of the front plate, and the pseudo-discharge port of the rear plate is disposed at a position opposed to the discharge port of the front plate. According to this aspect, since the rear plate is also formed with the intake port and the pseudo-discharge port, pressure of the rotor between the front plate and rear plate are balanced, the rotor is not pushed against one of the plates, and the rotor can smoothly rotate.

According to the sixth aspect of the invention, in the vane rotary type air pump of the fifth aspect, the pseudo-discharge port has the same shape as that of the discharge port. According to this aspect, since the pseudo-discharge port is provided, the rotor is not pushed against the rear plate by the pressure of the discharge port, and the rotor can smoothly rotate.

According to the seventh aspect of the invention, the opened end of the vane groove is provided in a reversed rotation direction region of the rotor with respect to straight line connecting a center of the rotor and the closed end of the vane groove. According to this aspect, the vane groove is provided on the rear side in the rotation direction. With this, when the rotor rotates, the tip end of the vane contacts and slides in a "stroke" positional relation with respect to the inner surface of the cylinder. If a friction force is generated on the tip end of the vane, this friction force acts such as to bring the tip end of the vane into contact with the inner surface of the cylinder, and a jumping phenomenon is prone to be generated when the vane contacts with and slides on the inner surface of the cylinder. According to this aspect, this jumping phenomenon can be suppressed, and low noise can be realized for a long term.

PREFERRED EMBODIMENT

Figure 2:
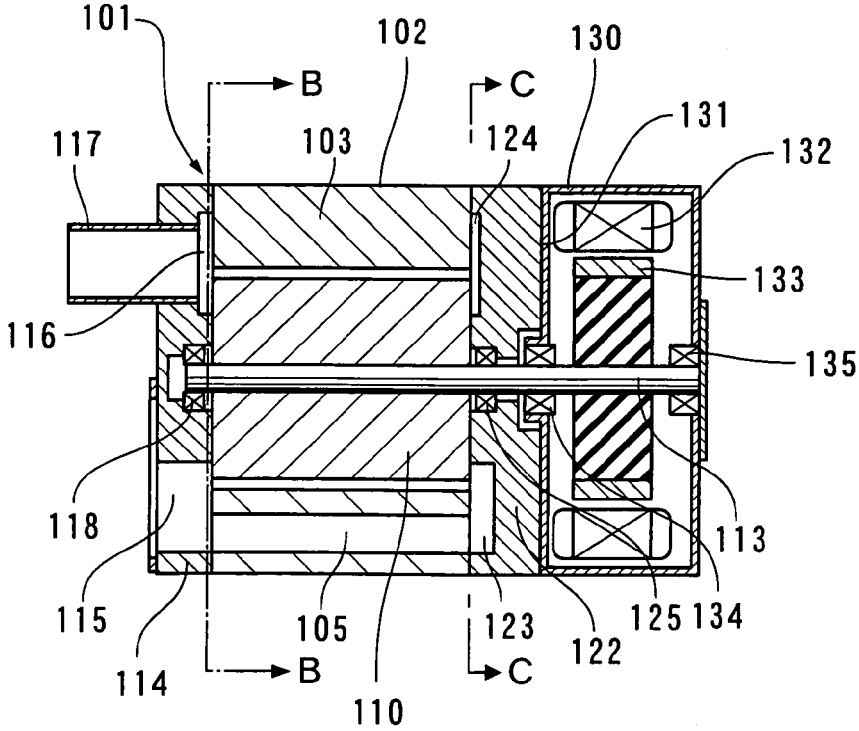
FIG. 2 is a sectional view of the vane rotary type air pump shown in FIG. 1 taken along the line A-O-A.

FIG. 1 is a sectional view of a vane rotary type air pump of an embodiment of the present invention, and FIG. 2 is a sectional view of the vane rotary type air pump shown in FIG. 1 taken along the line A-O-A.

In FIGS. 1 and 2, an air pump main body 101 of a vane rotary type air pump of the embodiment comprises a pump mechanism 102 and a drive motor 130.

The pump mechanism 102 includes a cylinder 103 having a cylindrical cylinder inner surface 104, and a cylindrical rotor 110 disposed in the cylinder 103. A center axis of the rotor 110 is deviated from a center axis of the cylinder 103 by a predetermined amount. Two vane grooves 111 are formed in the rotor 110. The vane grooves 111 extend in the direction of the center axis and incline rearward in the rotation direction. Plate-like vanes 112 are slidably inserted into the vane grooves 111. Each of the vanes 112 is made of carbon material in which graphite having self-lubricating properties is mixed. Tip ends of the vanes 112 contact with and slide on the cylinder inner surface 104 of the cylinder 103. The rotor 110 and the cylinder 103 are made of aluminum alloy in this embodiment and are lightened. The aluminum alloy has silicon content of about 10%.

A front plate 114 and a rear plate 122 are mounted on both end surfaces of the cylinder 103 such as to sandwich the rotor 110 and the vanes 112. A plurality of pump spaces 129 are surrounded and formed by the cylinder 103, the rotor 110, the vanes 112, the front plate 114 and the rear plate 122. Sliding surfaces of the front plate 114 and the rear plate 122 are coated with materials having self-lubricating properties such as disulfide molybdenum.

Figure 3:
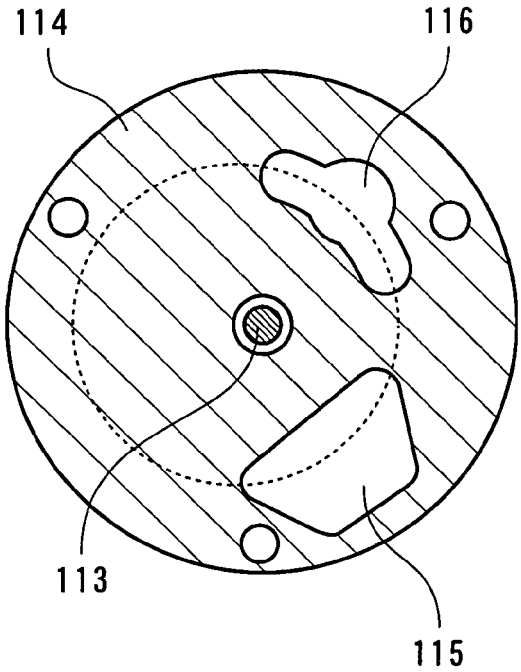
FIG. 3 is a sectional view of a front plate of the vane rotary type air pump shown in FIG. 2 taken along the arrows B-B.

FIG. 3 is a sectional view of a front plate 114 of the vane rotary type air pump shown in FIG. 2 taken along the arrows B-B.

As shown in FIGS. 2 and 3, the front plate 114 is formed with an intake opening 115 and a discharge port 116, and a discharge pipe 117 is mounted on the discharge port 116. The intake opening 115 is a hole penetrated in the front plate 114 in the axial direction. The discharge port 116 is a recessed port and is formed at its central portion with a through hole. The discharge pipe 117 is provided on this through hole.

Figure 4:
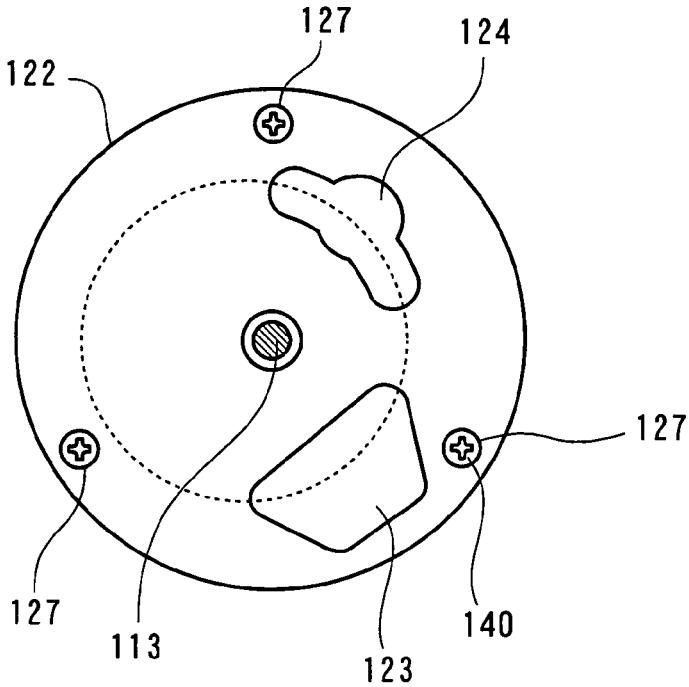
FIG. 4 is a sectional view of a rear plate of the vane rotary type air pump shown in FIG. 2 taken along the arrows C-C.

FIG. 4 is a sectional view of the rear plate 122 of the vane rotary type air pump shown in FIG. 2 taken along the arrows C-C.

As shown in FIG. 4, the rear plate 122 is formed with a recessed intake port 123 and a recessed pseudo-discharge port 124. The discharge port 116 and the pseudo-discharge port 124 have substantially the same shapes as viewed from the B-B direction. In FIG. 1, the intake port 123 and the discharge ports 116 and 124 are shown with broken lines. The cylinder 103 is provided with an intake passage 105 penetrating the cylinder 103 in the axial direction. The intake opening 115 and the intake port 123 are in communication with each other through the intake passage 105.

A drive motor 130 is disposed on the rear plate 122 on the opposite side from the pump mechanism such that the drive motor 130 is in direct contact with the rear plate 122. A plurality of screw holes 127 are formed in the rear plate 122 along its inner circumference. The rear plate 122 is directly fastened to a casing end surface 131 of the drive motor 130 by means of a plurality of screws 140.

The drive motor 130 is a direct-current motor comprising cylindrical coils 132 and a rotor 133 having a permanent magnet. The rotor 133 includes a long rotation shaft 113. The rotation shaft 113 is supported by the motor bearings 134 and 135 in the drive motor 130. The rotation shaft 113 penetrates the rear plate 122 from the drive motor 130 and extends through the pump mechanism 102. In the pump mechanism 102, the rotation shaft 113 is supported by a bearing 118 in the front plate 114 and a bearing 125 in the rear plate 122. A rotor 110 is fixed to the rotation shaft 113 in the pump mechanism 102, and a rotation force generated by the drive motor 130 is transmitted to the rotor 110 through the rotation shaft 113.

In the vane rotary type air pump of the embodiment having the above-described structure, when the drive motor 130 is energized, the mutually connected rotation shaft 113 and rotor 110 integrally rotate in the direction of arrow in FIG. 1. At that time, the vanes 112 move outward in the vane grooves 111 by centrifugal force of the rotation, and the vanes 112 rotate in a state where tip ends of the vanes 112 contact with and slide on the cylinder inner surface 104. As a result, each pump space 129 expands and contracts (volume is varied) and thus, air is sucked from the intake opening 115 of the front plate 114, a portion of the air is directly sucked into the pump space 129, and remaining air passes through the intake passage 105 which penetrates the cylinder 103 in the axial direction and then, is sucked into the pump space 129 through the intake port 123 formed in the rear plate 122. The pressure of the air which flows into the pump space 129 is increased during substantially one rotation ($\Delta P=5$ kPa) and then, the air flows out from the discharge pipe 117 through the discharge port 116 formed in the front plate 114.

The pseudo-discharge port 124 applies the same pressures to left and right sides of the rotor 110. If the pseudo-discharge port 124 exists, pressures on the front plate 114 and the rear plate 122 of the rotor 110 are balanced, the rotor 110 is not pushed against one of the plates, and wearing is not generated easily.

If the above-described oilless operation is continued for a few thousand hours, the tip ends of the vanes 112 contact with and slide on the cylinder inner surface 104 for a long distance, the cylinder inner surface 104 roughens, and surface roughness increases.

Figure 7:
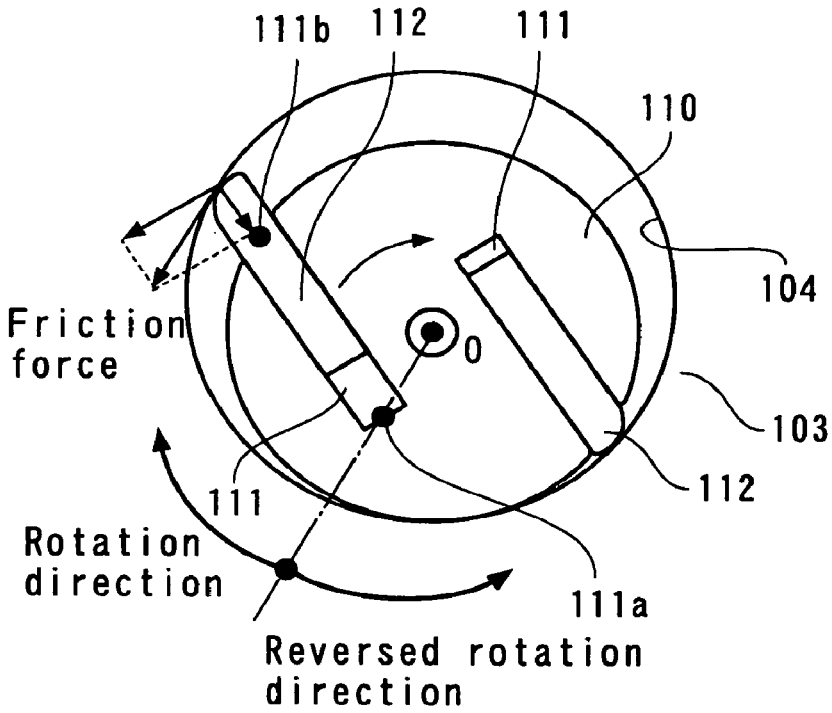
FIG. 7 is a schematic diagram of a conventional vane rotary type air pump.
Figure 8:
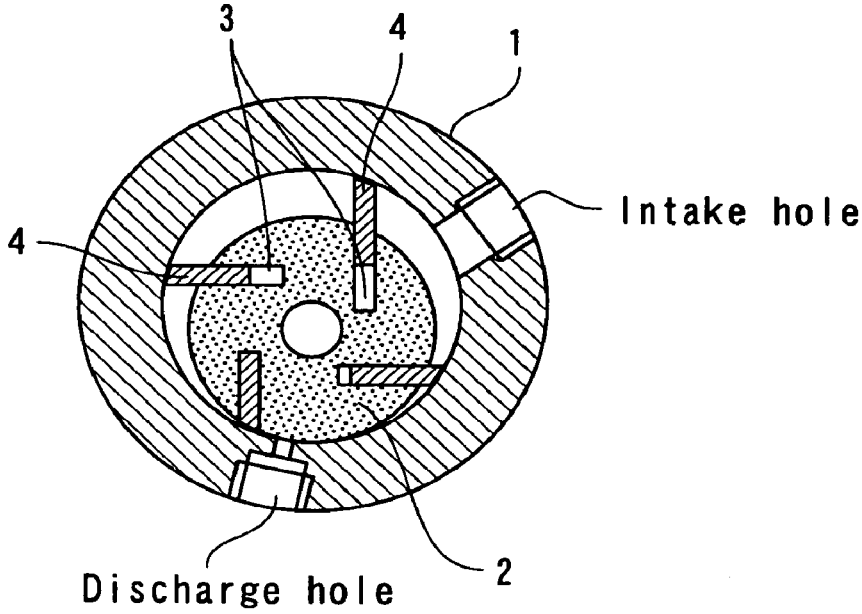
FIG. 8 PRIOR ART
FIG. 8 is a sectional view of the conventional vane rotary type air pump.
Figure 9:
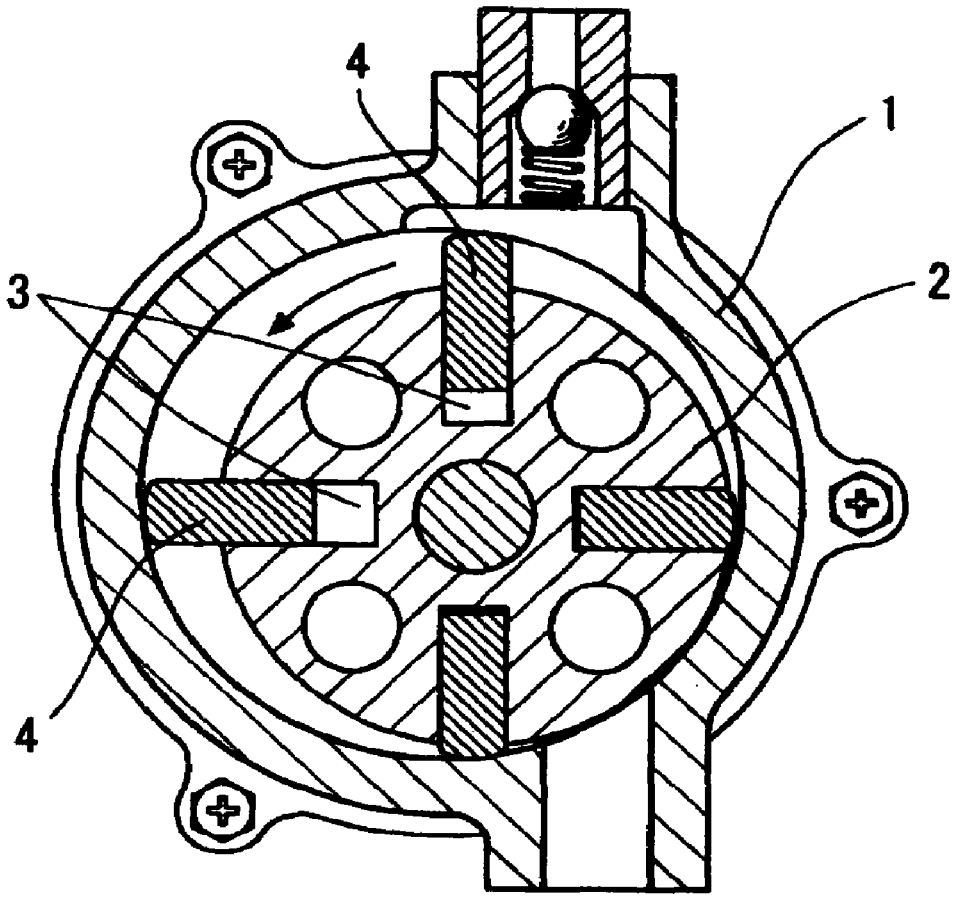
FIG. 9 PRIOR ART
FIG. 9 is a sectional view of another conventional vane rotary type pump.

According to the conventional vane rotary type machine (e.g., the vane rotary type vacuum pump shown in the background technique), as shown in the schematic diagram of the conventional vane rotary type air pump in FIG. 7, a main type in which the tip ends of the vane 112 contact with and slide on the cylinder inner surface 104 is the "scooping" type. An open end 111*b* of each of the vane grooves 111 is provided in a region in the rotation direction of the rotor 110 with respect to a straight line connecting the center O of the rotor 110 and the closed end 111*a* of each of the vane grooves 111 with each other. In other words, the open end 111*b* is inclined in the rotation direction.

In the "scooping" positional relation between the vane 112 and the cylinder inner surface 104, if the roughness of the cylinder inner surface 104 is increased, a friction force generated on each the tip end of the vane 112 is increased, a parting force in the vane direction of the friction force acts such as to pull the vane 112 into the vane groove 111. If the parting force becomes greater than the centrifugal force acting on the vane 112, the moment at which the tip end of the vane 112 separates from the cylinder inner surface 104 is generated, and the jumping phenomenon of the vane 112 is generated.

Figure 5:
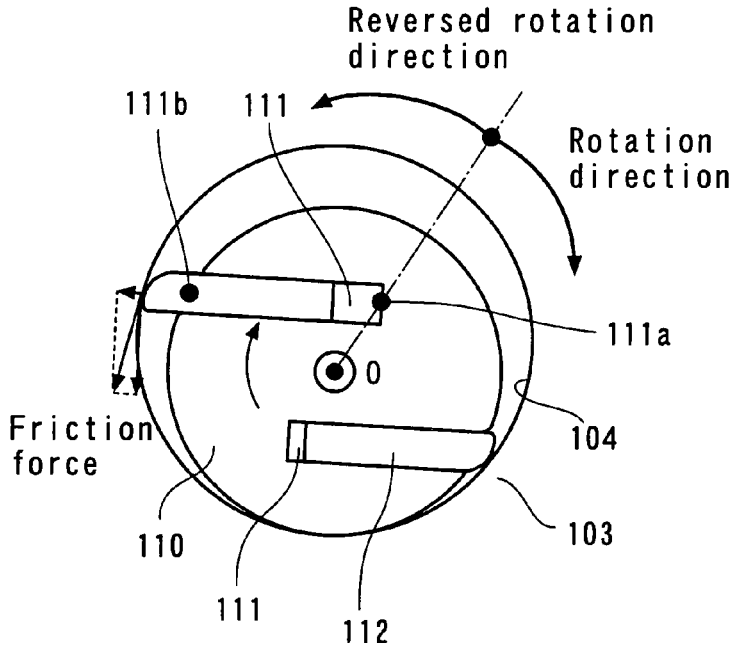
FIG. 5 is a schematic diagram of the vane rotary type air pump of the embodiment.

In the vane rotary type air pump of this embodiment which is operated in the oilless manner for a long term, as shown in the schematic diagram of the vane rotary type air pump of this embodiment of FIG. 5, the type in which the tip ends of the vanes 112 contact with and slide on the cylinder inner surface 104 is set to a "stroke" type. The open end 111*b* of each of the vane grooves 111 is provided in a region in the reverse rotation direction of the rotor 110 with respect to the straight line connecting the center O of the rotor 110 and the closed end 111*a* of that vane groove 111. In other words, the open end 111*b* is inclined rearward in the rotation direction.

With this structure, even when the surface of the cylinder inner surface 104 roughens and the friction force acting on the tip end of the vane 112 is increased, the parting force in the vane direction acts such that the vane 112 is pushed against the cylinder inner surface 104 and thus, the tip end of the vane 112 does not separate from the cylinder inner surface 104. Therefore, even if the air pump is operated in the oilless manner for a long term, the jumping phenomenon of the vane 112 is not generated, noise is prevented from increasing, and a quiet air pump can be provided.

In the vane rotary type air pump of the embodiment, the material of the vane 112 is carbon material in which graphite is mixed, and the surface of the cylinder 103 is made of material having higher hardness than that of the vane 112 and corrosion resistance. More concretely, the vane 112 is made of such carbon material that a firing temperature of the vane 112 is set 1200° C. or higher, thereby increasing the ratio of graphite content, Shore hardness is set to Hs120 or lower. The surface of the cylinder 103 made of aluminum alloy is subjected to a surface processing (coating) of Ni—P (nickel-phosphorus), and the surface hardness is set to Vickers hardness of Hv500 or higher.

Figure 6:
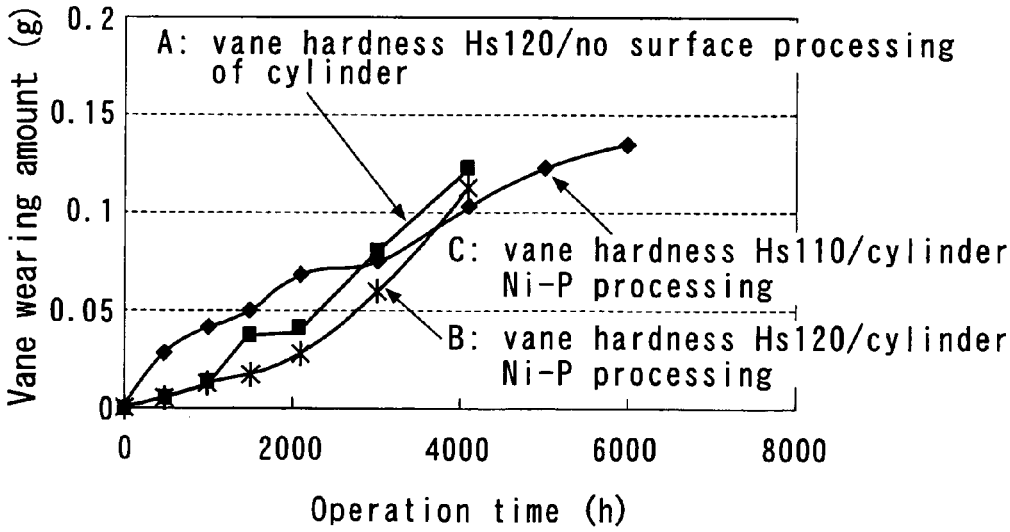
FIG. 6 is a characteristic diagram of a wear amount of a vane with operation time.

FIG. 6 is a characteristic diagram of a wear amount of the vane with operation time. FIG. 6 shows variations of a wear amount of the vane 112 according to elapsed time, in the state that three combinations are prepared concerning the surface processing of the vane 112 and the cylinder 103, and the air pump is continuously operated for a long term.

A: vane hardness Hs120/no surface processing of cylinder

B: vane hardness Hs120/cylinder Ni—P processing

C: vane hardness Hs110/cylinder Ni—P processing

As can be found from FIG. 6, if A and B are compared with each other, as a result of the oilless operation for a long term, it can be found that if the cylinder 103 is subjected to the surface processing of Ni—P and its surface hardness is enhanced, the wear amount of the vane 112 is small. The hardness of the surface processing portion is about Hv500 to 700. It is conceived that since the surface of the cylinder 103 is hardened, the roughness of the cylinder inner surface 104 is reduced when the vane 112 contacts and slides on the surface and as a result, the wear amount of the vane 112 is reduced. Simultaneously, when the cylinder 103 of B is subjected to the surface processing, it was confirmed that the noise at the time of operation is also low. The Ni—P surface processing has corrosion resistance, there is an effect that air pump is smoothly operated even if the air pump main body 101 absorbs water. With this, if the surface of the cylinder 103 is made of material having higher hardness than that of the vane 112 and having corrosion resistance, the life of the pump can be increased, and increase in noise can be suppressed.

In the result of FIG. 6, Ni—P-based material is indicated as the surface processing of the cylinder 103. The same effect can be obtained even if Ni—P-B-based material is used. If boron (B) is added, the surface hardness is further increased, and there is an effect that the wear of the vane 112 and cylinder inner surface 104 can be reduced and as a result, it is possible to realize long life and low noise of the pump.

If B and C in FIG. 6 are compared with each other, it can be found that if the hardness of the vane 112 is low, there is a tendency that the wear amount of the vane 112 after the long term operation is small. It is conceived that this is because if the vane 112 is made of carbon material having low Shore hardness, wearing powder of vane 112 is generated when the tip end of the vane 112 slides on the cylinder inner surface 104, but a great amount of graphite is included in the generated wearing powder, and the sliding portion is lubricated by the graphite powder. Even if the pump is operated for a long term, the roughness of the cylinder inner surface 104 is suppressed, the life of the pump can be increased, and the increase of noise can be suppressed.

In the embodiment, it was confirmed that if the Shore hardness of the vane 112 was Hs120 or less, there was no problem and there was an effect. If the Shore hardness is excessively low, initial wear is large, and the lower limit of the hardness is preferably about Hs80.

The same effect is exhibited even if carbon fiber reinforced plastics are used instead of carbon material as the material of the vane.

INDUSTRIAL APPLICABILITY

According to the vane rotary type air pump of the present invention, even if the pump is operated in the oilless manner for a long term, the jumping phenomenon of the vane can be overcome, and noise can be suppressed to low level, and lifetime of the pump can be increased by suppressing wear of the vane and roughness of the cylinder inner surface. Therefore, the vane rotary type air pump of the invention can also be applied to a domestic health instruments and medical treatment instruments.

The invention claimed is:

1. A vane rotary type air pump in which a pump mechanism and a drive motor are provided side-by-side, said pump mechanism comprises a cylinder having a cylindrical inner surface, a cylindrical rotor which eccentrically rotates in said cylinder, a vane groove having an opened end in an outer peripheral surface of said rotor and a closed end on the side of a center of said rotor, a vane which slides in said vane groove, a rotation shaft which rotates in unison with said rotor, and front and rear plates which are mounted on both end surfaces of said cylinder such as to sandwich said rotor and said vane, said pump mechanism is formed with a plurality of pump spaces, and said rotation shaft is driven by said drive motor to vary volumes of said pump spaces, wherein said opened end of said vane groove is provided in a reversed rotation direction region of said rotor with respect to straight line connecting a center of said rotor and said closed end of said vane groove wherein said front plate is formed with an intake opening and a discharge port, said rear plate is formed with an intake port and a pseudo-discharge port, said intake port of said rear plate is disposed at a position opposed to said intake opening of said front plate, and said pseudo-discharge port of said rear plate is disposed at a position opposed to said discharge port of said front plate.

2. The vane rotary type air pump according to claim 1, wherein a base material of said vane is carbon material in which graphite is mixed or a carbon fiber reinforced plastics, and a surface of said cylinder is made of material having higher hardness than that of said vane and having corrosion resistance.

3. The vane rotary type air pump according to claim 1, wherein said cylinder is made of aluminum alloy, said cylinder is subjected to surface processing using Ni-P-based material or Ni-P-B-based material, and Vickers hardness (Hv) of the surface of said cylinder is set to 500 or higher.

4. The vane rotary type air pump according to claim 1, wherein said vane is made of carbon material having Shore hardness (Hs) of 80 to 120.

5. The vane rotary type air pump according to claim 1, wherein said pseudo-discharge port has the same shape as that of said discharge port.

* * * * *